US009273469B2

(12) United States Patent
Annen

(10) Patent No.: US 9,273,469 B2
(45) Date of Patent: Mar. 1, 2016

(54) APPARATUS FOR REMOTE OPERATION ON A ROOFTOP

(71) Applicant: Michael John Annen, Hudson, WI (US)

(72) Inventor: Michael John Annen, Hudson, WI (US)

(73) Assignee: Michael J. Annen, Hudson, WI (US)

( * ) Notice: Subject to any disclaimer, the term of this patent is extended or adjusted under 35 U.S.C. 154(b) by 7 days.

(21) Appl. No.: 13/849,504

(22) Filed: Mar. 23, 2013

(65) Prior Publication Data

US 2014/0283417 A1 Sep. 25, 2014

(51) Int. Cl.
*E04D 13/10* (2006.01)

(52) U.S. Cl.
CPC ..... *E04D 13/106* (2013.01)

(58) Field of Classification Search
CPC ..... E04D 13/106; E01H 5/02
USPC ..... 37/264, 265, 266, 268, 285; 294/54.5
See application file for complete search history.

(56) References Cited

U.S. PATENT DOCUMENTS

| | | | | | |
|---|---|---|---|---|---|
| 4,089,127 | A * | 5/1978 | Maijala | 37/268 |
| 5,076,119 | A * | 12/1991 | Wenz | 81/45 |
| 5,083,388 | A * | 1/1992 | Cooley | 37/268 |
| 5,465,510 | A * | 11/1995 | Goodnough et al. | 37/285 |
| 5,676,413 | A * | 10/1997 | Hauck | 294/54.5 |
| 5,943,796 | A * | 8/1999 | Hedstrom | 37/285 |
| 6,158,791 | A * | 12/2000 | Drew | 294/54.5 |
| 6,189,942 | B1 * | 2/2001 | Peterson et al. | 294/54.5 |
| 6,202,329 | B1 * | 3/2001 | Supplee et al. | 37/285 |
| 6,338,210 | B1 * | 1/2002 | Mele | 37/285 |
| 6,578,890 | B1 * | 6/2003 | Ross et al. | 294/54.5 |
| 6,668,491 | B1 * | 12/2003 | Bonerb | 52/1 |
| 7,296,368 | B1 * | 11/2007 | Rigo | 37/285 |
| 7,867,338 | B1 * | 1/2011 | Salvant | 134/6 |
| 8,347,528 | B1 * | 1/2013 | Seltzer | 37/265 |
| 2006/0026909 | A1 * | 2/2006 | Cross | 52/127.5 |
| 2007/0151422 | A1 * | 7/2007 | Kingham | 81/45 |

FOREIGN PATENT DOCUMENTS

JP 2012219612 A * 11/2012

* cited by examiner

*Primary Examiner* — Jamie L McGowan

(57) ABSTRACT

An apparatus for remotely performing an operation on a roof including a frame assembly configured to be positioned on the roof, a pivot assembly configured to couple to an external anchor point such that the frame assembly is positioned between the pivot assembly and an operating position, and a flexible control line including a first segment having a first end coupled to the frame assembly and extending in substantially a first direction to a second end disposed at the operating position, and a second segment having a first end coupled to the frame assembly and extending in a second direction substantially opposite the first direction through the pivot assembly, which redirects the second segment to the first direction, to a second end at the operating position, wherein pulling the second ends of the first and second segments controls movement of the frame assembly on the roof.

22 Claims, 6 Drawing Sheets

371

320
302
340b
350
340a
310
1

APPARATUS FOR REMOTE OPERATION ON A ROOFTOP

BACKGROUND

Often it is necessary to perform operations on the roof of a building when weather conditions or a physical state of the roof (e.g., roof height, slope, integrity, laden with snow or ice) make it difficult or unsafe for a person to physically climb onto the roof to perform the desired operations. For example, the removal of debris from the roofs of commercial buildings and homes, in particular the removal of snow, is often necessary. Heavy snow loads can stress the structural integrity of roofs. If the snow load of a heavily-laden roof is not lightened, there is risk of structural failure of the roof, which can lead to both injury and interior building damage. Additionally, when snow is present on a roof, freeze/thaw cycles can lead to the build-up of ice on the roof eves. This ice build-up is commonly referred to as an "ice dam". Ice dams can damage the roof/eves, and lead to water leaking into the building walls and building interior. As such, partial or complete removal of snow from a roof is desirable to minimize the potential for structural collapse of the roof and to prevent the formation of ice dams that can lead to water damage within the building.

Devices for removing snow from rooftops are ubiquitous. Such devices fall into two general categories: roof rakes (also known as roof shovels) and snow cutters. Roof rakes comprise a scraper attached to a long rigid handle, typically several meters in length. The scraper is positioned near the top of the roof and pulled down the roofline by means of the handle, thereby pulling or "raking" the snow off the roof. The scraper is then pushed back up to the top of the roof, repositioned adjacent to the cleared section, and the process repeated until the roof is cleared of snow. Snow cutters comprise a frame having an underside to which a flexible, elongated sheet of low coefficient of friction material is attached. The snow cutter is maneuvered by means of a long rigid handle. The frame is positioned at the eve of the roof, and by means of the handle, is pushed up toward the peak or apex of the roof. The frame "cuts" a section of snow as the low coefficient of friction polymeric sheet rides under the snow, causing the snow to slide down the sheet and off the roof. The frame is then pulled down, repositioned at the eve of the roof adjacent to the cleared section, and the process repeated until the roof is cleared of snow.

Both roof rakes and snow cutters rely on the long rigid handle to position and operate the apparatus. Since the operator requires line-of-sight to remove the snow, the length of the rigid handle can become quite long depending on the length, height and pitch of the roof, wherein the longer the handle length, the more difficult the rake or cutter becomes to maneuver.

SUMMARY

One embodiment provides an apparatus for remotely performing an operation on a roof, the apparatus including a frame assembly configured to be positioned on a roof, a pivot assembly configured to couple to an external anchor point such that the frame is positioned between the pivot assembly and a user operating position, and a flexible control line having a first segment with a first end coupled to the frame assembly and extending in substantially a first direction to a second end disposed at the operation position, and a second segment having a first end coupled to the frame assembly and extending in a second direction substantially opposite the first direction through the pivot assembly which redirects the second segment to the first direction to a second end at the operating position, wherein pulling the first and second segments controls movement of the frame assembly on the roof.

According to one embodiment, the apparatus provides for snow removal from the roof, wherein the frame assembly includes a face plate having a bottom edge disposed on the roof, a top edge, and a pair of side edges which form a first face and an opposing second face. In one embodiment, pulling the second segment in the first direction moves the faceplate toward an apex of the roof with the second face facing the apex, and pulling the first segment in the first direction pulls the faceplate toward an eve of the roof with the first face facing the eve to pull snow from the roof.

DESCRIPTION OF EMBODIMENTS

According to embodiments described herein, an apparatus for remotely performing operations on a roof is provided which employs a flexible control line in conjunction with a pivot assembly coupled to an external anchor point to control movement of the apparatus on the roof. By employing the flexible control and pivot assembly, the apparatus can be easily and safely operated to remotely perform operations on a roof, and, in the case of snow removal devices with the need for a long and cumbersome handle being eliminated.

Figure 1:
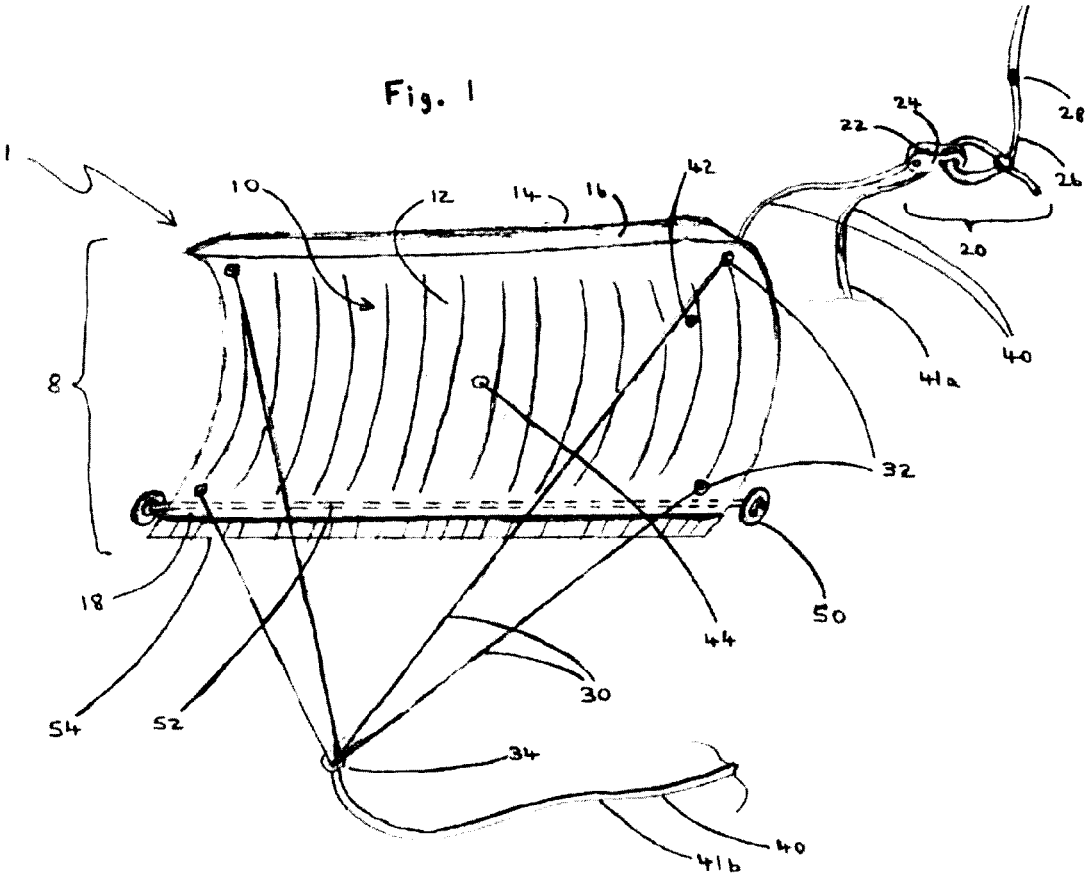
FIG. 1 is a perspective view illustrating an apparatus for remotely performing operations on a roof, configured as a roof rake, according to one embodiment.

FIG. 1 illustrates one embodiment of an apparatus 1 for remotely performing an operation on a roof, wherein the apparatus 1 is configured as a snow rake 8 for removing snow from a roof. According to one embodiment, snow rake 8 includes a frame assembly 10, a pivot assembly 20, and a flexible control line 40. As illustrated, frame assembly 10 comprises a rectangular face plate 10. According to one embodiment, as shown, face plate 10 is concave, but it is noted that other geometries, such as planar or bifurcated structures, are also contemplated. Face plate 10 includes a first face 12, an opposing second face 14, a top edge 16, and a bottom edge 18. According to one embodiment, first face 12 forms a front side and second face 14 forms a back side. According to one embodiment, to facilitate efficient removal of snow, face plate 10 may be constructed of, or coated with, a low coefficient of friction material such as a polyolefin, a fluoropolymer, or a silicone.

According to one embodiment, as shown, pivot assembly 20 includes a wheel 22, held in position by frame 24. According to one embodiment, frame 24 is secured by an anchor line 26 to an anchor point 28, such as the roof. Alternatively, anchor point 28 may be a roof fixture, such as a chimney, or a fixture on the opposite side of the building or ground, such as tree or post, for example (not shown). Anchor line 26 may be a rope, strap, chain, or the like. While pivot assembly 20, as shown, is a pulley assembly, other suitable pivot assemblies, such as a gear or cog mechanism, are also envisioned.

According to one embodiment, retaining arms 30 are couple to, and protrude from, the front side 12 of face plate 10 at points 32 and are co-joined at a nexus 34. According to one embodiment (see FIG. 5), a first segment 41*b* of flexile control line 40 is coupled at a first end to nexus 42 and extends in a first direction to a second end at an operating position (e.g., a location on the ground below the roof) of a user (e.g., a homeowner). According to one embodiment (not shown), nexus 34 may comprise a ring through which the first segment 41*b* of flexible control 40 passes and is secured to the front side 12 of face plate 10 at attachment point 44. A second segment 41*a* of flexible control line 40 is secured to the back side 14 of face plate 10 at 42, extends in a second direction away from the first direction, passes through pivot assembly 20 which redirects second segment 41*a* in the first direction, and extends to a second end at the user operating position. In one embodiment, as illustrated, attachment of the second segment 41*a* of control line 40 is proximate to a corner of the back side 14 of face plate 10. While illustrated as comprising two separate segments, according to one embodiment, the first ends of first and second segments 41*a* and 41*b* of flexible control line 41 are joined so as to form a continuous control line.

As described herein, retaining arms 30 and control line 40 may be bolted through, or bonded to, the surface of face plate 10. Flexible control line 40 may be a rope, a chain, an elastic cord (such as those available under the trade designation "BUNGEE CORD"), or the like.

According to one embodiment, to facilitate movement up and down the roof, wheels 50 are provided adjacent to outside edges of bottom edge 18 of face plate 10 and mounted on an axle 52. According to one embodiment, to aid in snow or ice removal without damaging the roof, a flexible blade 54 is provided on the bottom edge of face plate 18.

Figure 2:
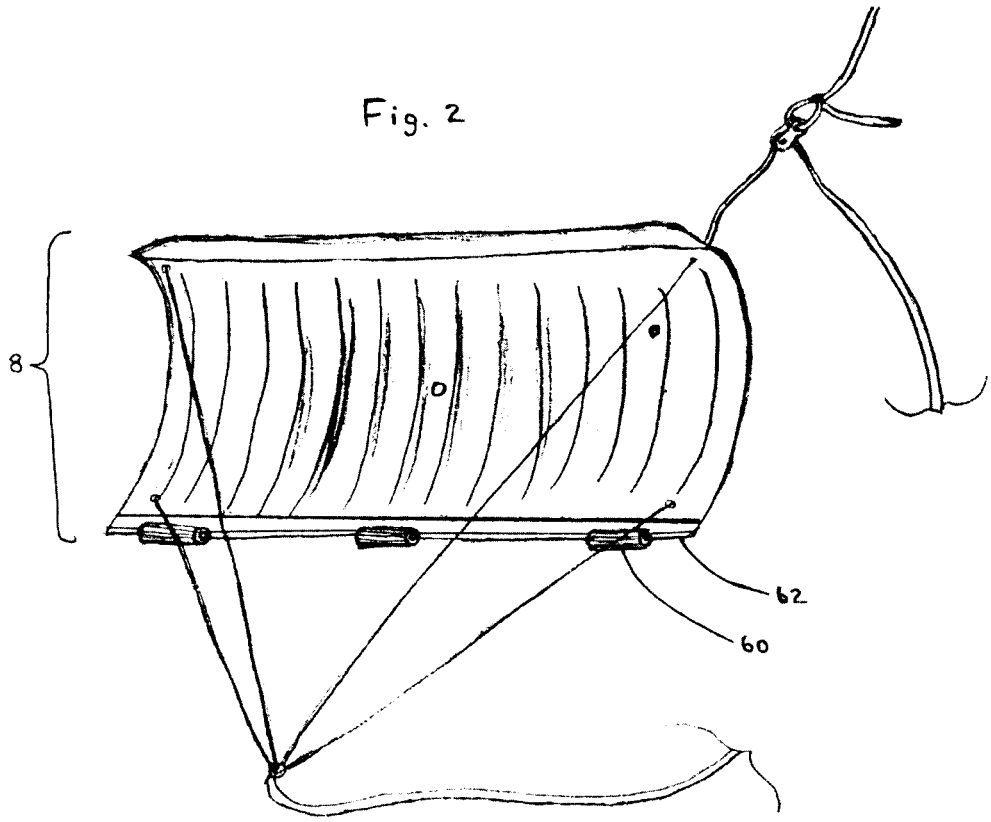
FIG. 2 is a perspective view illustrating an apparatus for remotely performing operations on a roof, configured as a roof rake, according to one embodiment.

FIG. 2 illustrates one embodiment of snow rake 1, wherein rollers 60 are provided on an axle 62 along the bottom edge of face plate 18 in lieu of wheels 50.

Figure 3:
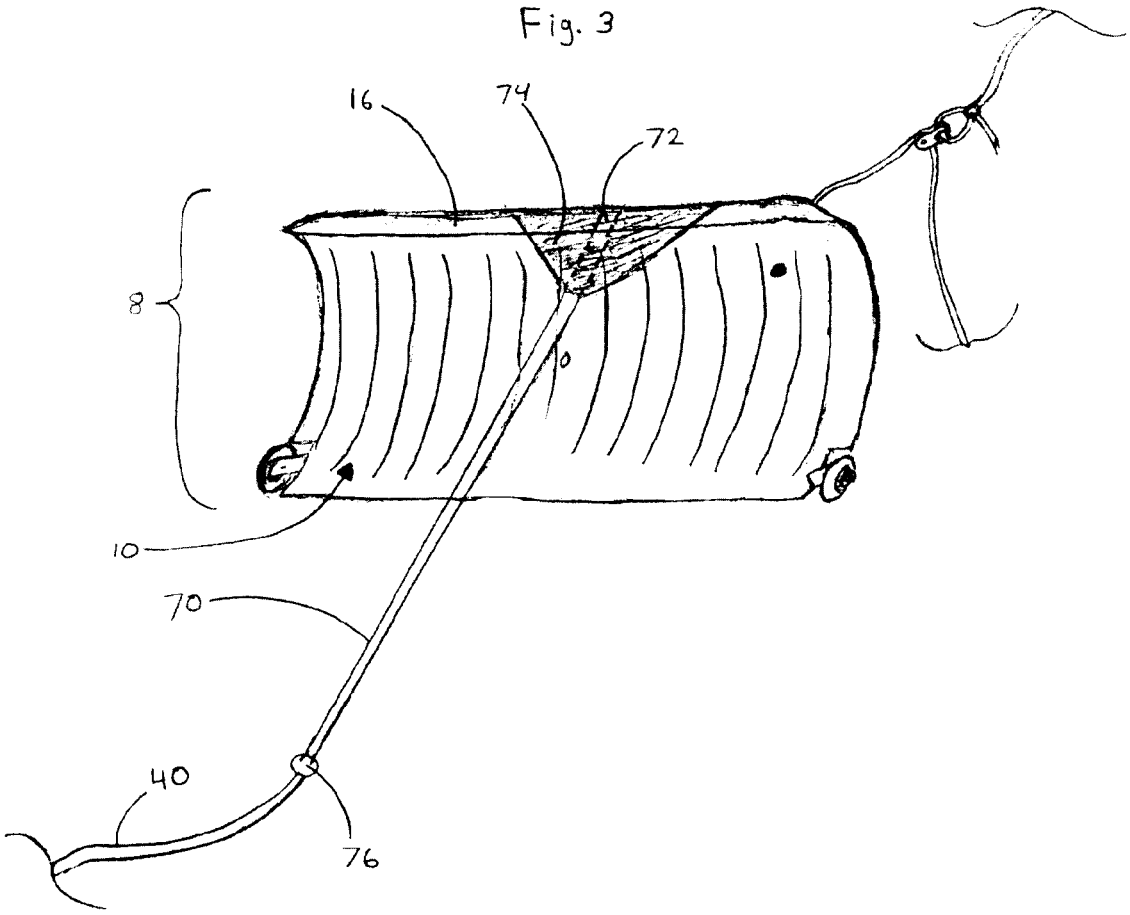
FIG. 3 is a perspective view illustrating an apparatus for remotely performing operations on a roof, configured as a roof rake, according to one embodiment.

FIG. 3 illustrates one embodiment of snow rake 1, wherein a retaining arm 70 is secured at one end 72 to the top of face plate 16 by means of brace 74, in lieu of multiple retaining arms 32. Flexible control line 40 is secured to opposing end 76 of retaining arm at 70. Although not shown, other suitable embodiments of attaching retaining arm 70 to rake assembly 8 include securing retaining arm 70 onto the center of face plate 10 by means of a bolt, a flange, or cementing with adhesive.

Figure 4:
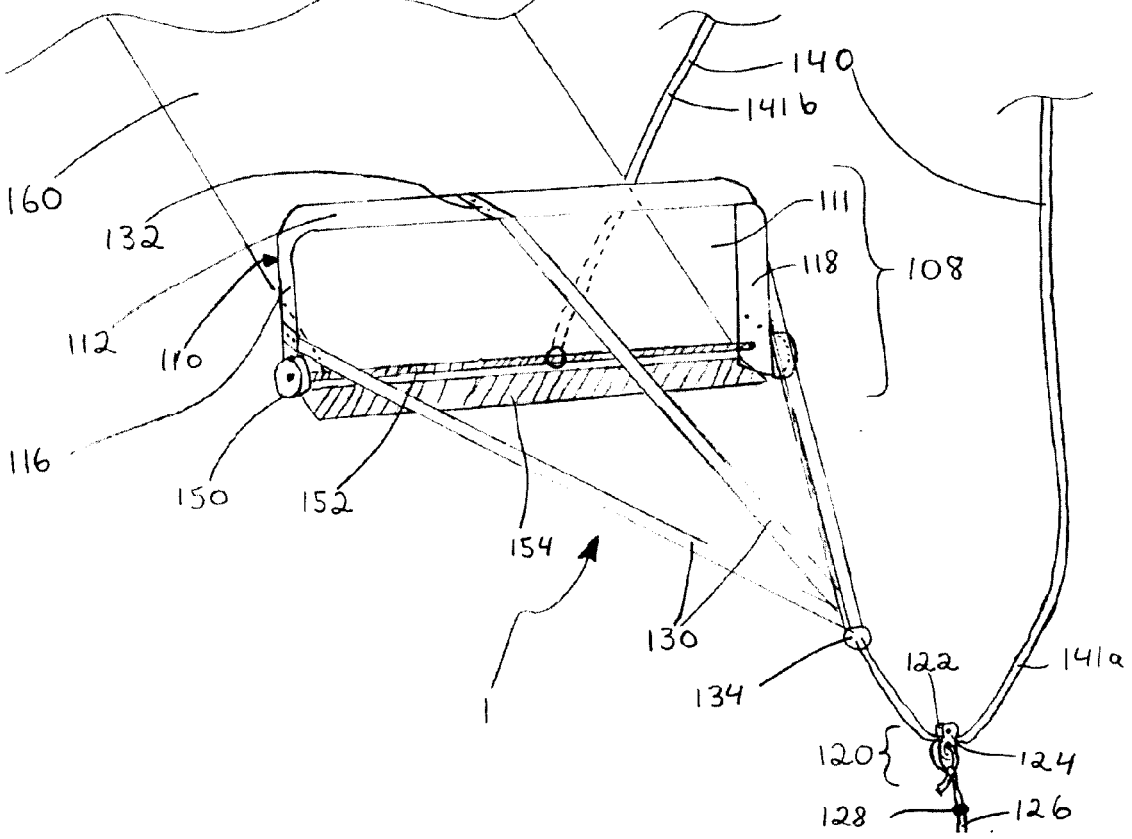
FIG. 4 is a perspective view illustrating an apparatus for remotely performing operations on a roof, configured as a snow cutter, according to one embodiment.

FIG. 4 illustrates one embodiment of apparatus 1 for remotely performing an operation on a roof, wherein apparatus 1 is configured as a snow cutter 108. According to one embodiment, snow cutter 108 includes a plurality of structural elements including an upper member 112, vertical side members 116 and 118, and an axle 152 that form a perimeter structure or frame 110 defining an open central space 111. Although not shown, the generally rectangular frame 110 may include a lower member parallel to axle 152.

A pivot assembly 120, represented by a pulley mechanism having wheel 122, is held in position by means of frame 124 which is secured by an anchor line 126 to the roof, a roof fixture, or a fixture on the opposite side of the building or ground (not shown). While a pulley assembly is shown, other pivot assemblies such as a gear or cog mechanism are also envisioned. A plurality of retaining arms 130 are attached to and protrude from a back side of rectangular frame 110 (i.e. the side of frame 110 facing an apex of a roof on which snow cutter 108 is positioned) at points 132 and are co-joined at a nexus 134. Alternatively, a single retaining arm secured to the frame by means of a brace (not shown) may be employed in lieu of the plurality of retaining arms 130. A first segment 141*a* of flexible control line 140 is secured to nexus 134 of retaining arms 130, extends through pivot assembly 120, and extends to a user operating position (see FIG. 5). A second segment 141*b* of flexible control line 140 is secured to axle 152 and also extends to the user operating position. While for illustrative purposes flexible control line 140 is shown attached to axle 152, it should be understood that it may be attached to any position on rectangular frame 110 or an elongated polymeric sheet 160 (see below). As described previously, flexible control line 140 may be a rope, a chain, an elastic cord, or the like. Furthermore, control line 140 may be a single line or, as illustrated, may comprise two separate control lines, 141*a* and 141*b*.

According to one embodiment, to facilitate movement up and down the roof, wheels 150 are provided on opposing ends of axle 152. Further, according to one embodiment, to aid in snow or ice removal without damaging roof shingles, a flexible blade 154 may be secured to the lower portion of rectangular frame 110. Secured to axle 152, or a lower frame member (not shown), and extending in the opposite direction to retaining arms 130, is a flexible elongated polymeric sheet 160. To aid in snow removal, flexible elongated sheet 160 is constructed of, or coated with, low coefficient of friction material, for example, a polyolefin, a fluoropolymer or a silicone.

Figure 5:
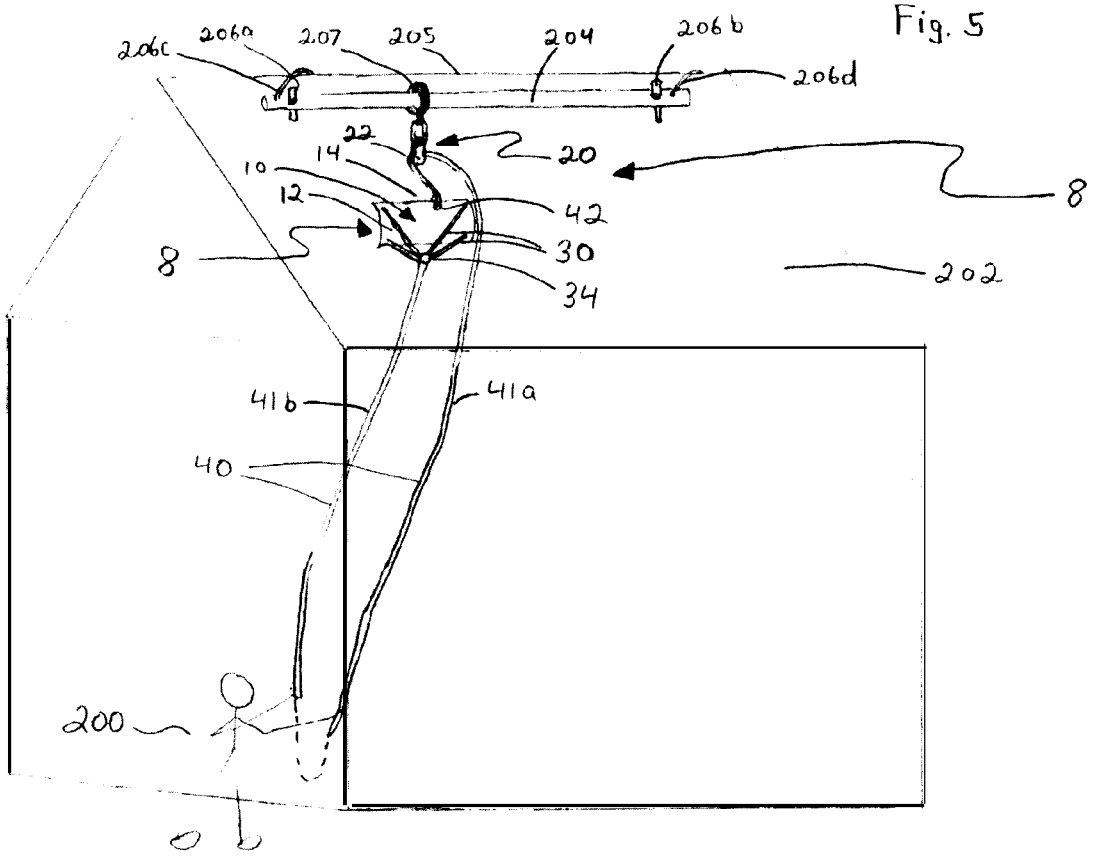
FIG. 5 is a perspective view illustrating an apparatus for remotely performing operations on a roof, configured as a snow removal device, according to one embodiment.

FIG. 5 is a perspective view illustrating a snow rake, according to one embodiment, such as snow rake 8 of FIG. 1, positioned on a roof 202. As illustrated, first segment 41*b* of flexible control line 40 is attached to nexus 34 of retaining arms 30 and extends user operating location 200 (e.g. a location on the ground). Second segment 41*a* of flexible control line 40 is attached to the back side 14 of face plate 10, extends through pivot assembly 20, and also extends to user operating location 200. According to one embodiment, as illustrated by the dashed lines, first and second segments 41*a* and 41*b* are joined such that flexible control line is a single, continuous segment.

According to one embodiment, a rail 204 is positioned adjacent to, and extends generally the length of apex 205 of roof 202, by means of ropes 206*c* and 206*d*. Ropes 206*c* and 206*d* are further secured to the ground or a structure on the opposite side of roof 202 (not shown). According to one embodiment, for ease of operation, rail 204 is orientated parallel to the ground. Pivot assembly 20 is slideably engaged with rail 204 by means of collar 207 that can slide between stops 206*a* and 206*b*. In one embodiment (not shown), pivot assembly 20 may be slideably engaged to a track, in lieu of rail 204, by means of a wheel or cog coextensively attached to wheel 22.

The operation of snow removal devices as described herein, such as snow rake 8 and snow cutter 108, is described below with reference to FIG. 1 through FIG. 5.

With reference to FIG. 1 and FIG. 5, snow rake 8 is positioned adjacent to, and with face plate 10 generally parallel to, the apex of a roof, such as the apex 205 of roof 202. Anchor line 26 of pivot assembly 20 is secured to anchor point 28. It is noted that it is not necessary for pivot assembly 20 and anchor line 26 be secured at anchor point 28 that is higher at than face plate 10. For example, anchor line 26 may be sufficiently long enough to be secured at anchor point 28 on the opposing side of the roof, such as on the ground, on the opposite side of the building. Alternatively, to avoid damaging roof shingles, anchor line 26 may be secured around a chimney or other roof structure. First segment 41*a* of flexible control line 40 is secured to the back side 14 of face plate 10 at 42, threaded around wheel 22 of pivot assembly 20, and extends to an operator 200 located beyond the eave of the roof, for example on the ground. Second segment 41*b* of flexible control line 40 is secured to the nexus 34 of retaining arms 30 protruding from the front side 12 of face plate 10 and extends to the position of operator 200.

To draw snow rake 8 down the roof toward the eave, operator 200 pulls on second segment 41*b* of flexible control line 40 closest to nexus 34 in a direction generally perpendicular to the apex 205 of roof 202. Snow is collected in front of face plate 10 as it is pulled and ultimately falls off the eave of the roof to the ground. The operator then returns snow rake 8 to the apex 205 of roof 202 by pulling on first segment 41*a* of flexible control line 40. Operator 200 then moves snow rake 8 laterally relative to the apex 205, such as along rail 204, so as to reposition snow rake 8 adjacent to the area of snow previously removed by pulling on flexible control line 40 at an obtuse angle to the roof apex. Operator 200 repeats the process until the all the snow is removed from the roof.

With reference to FIG. 4 and FIG. 5, snow cutter 108 is positioned adjacent to, and with the rectangular frame 110 generally parallel to an eave of a roof, such as roof 202. Anchor line 126 of pivot assembly 120 is then secured to anchor point 128. For reasons described previously, it is not necessary for pivot assembly 120 and anchor line 126 be secured at anchor point 128 that is higher than rectangular frame 110. First segment 141*a* of flexible control line 140 is secured to nexus 134 of retaining arms 130 and threaded over wheel 122 of pivot assembly 120, and extends to an operator 200 located beyond the eave of the roof, for example on the ground. Second segment 141*b* of flexible control line 140 is secured to axle 152 and extends to the position of operation 200.

Operator 200 proceeds to draw snow cutter 108 up toward the apex of the roof by pulling on the first segment 141*a* of flexible control line 140 in a direction generally perpendicular to the apex of the roof. As rectangular frame 110 travels up the pitch of the roof toward the apex, snow slides down the elongated polymer sheet 160 and ultimately falls off the eave of the roof to the ground. Operator 200 then returns rectangular frame 110 to the eave of the roof by pulling on the second segment 141*b* of flexible control line 140 attached to axle 152. Operator 200 then moves snow cutter 108 laterally relative to the eave of roof 202 so as to reposition rectangular snow cutter 108 adjacent to the area of snow previously removed by pulling on the flexible control line 140 at an obtuse angle to the roof eave. Operator 200 repeats the process until the all the snow is removed from the roof.

With reference to FIG. 5, rail 204 is positioned on roof 202 adjacent to apex 205 by means of ropes 206*c* and 206*d*. First segment 41*a* of flexible control line 40 is secured to the back side 14 of face plate 10 at 42, is threaded over wheel 22 of pivot assembly 20, and extends to operator 200 located beyond the eave of the roof, for example on the ground. Second segment 41*b* of flexible control line 40 and is then secured to the nexus 34 of retaining arms 30 protruding from the front side 12 of face plate 10 and extends to the position of operator 200. Operator 200 slides snow rake 8 to one end of rail 204 by pulling on flexible control line 40 at an obtuse angle to the apex 205 of roof 202. Operator 200 then pulls snow rake 8 down the roof from the apex toward the eave by pulling on second segment 41*b* of flexible control line 40. As snow rake 8 moves down the roof, snow collected in front of face plate 10 is pushed down the roof and ultimately falls off the eave of the roof to the ground. Operator 200 then returns snow rake 8 to the apex 205 of roof 202 by pulling on the first segment 41*a* of flexible control line 40, but in this instance in a direction generally perpendicular to the apex of the roof. The operator then slides snow rake 8 laterally along rail 204 to a position adjacent the area of snow previously removed, by pulling on the flexible control line 40 at an obtuse angle to apex of roof 205. The operator repeats this process until the all the snow is removed.

By employing a flexible control and a pivot assembly as described herein, snow removal devices according to embodiments described herein, such as snow rake 8 and snow cutter 108, can be easily and safely operated to remove snow from a roof while eliminating the need for a long and cumbersome handle as required by conventional snow removal devices.

Although described above primarily as a snow removal apparatus, the apparatus described herein can be adapted to perform any number of other operations on a roof. For example, according to one embodiment, the apparatus can be configured as a frame assembly on which any number of tools may be fitted. For example, the apparatus could be fitted with a vision system such that images of the roof could be remotely collected, such as for the purpose of inspecting the integrity of the roof surface or the condition of sealed surfaces of objects mounted to- or protruding through the roof such as roof vents, skylights or the like.

Figure 6:
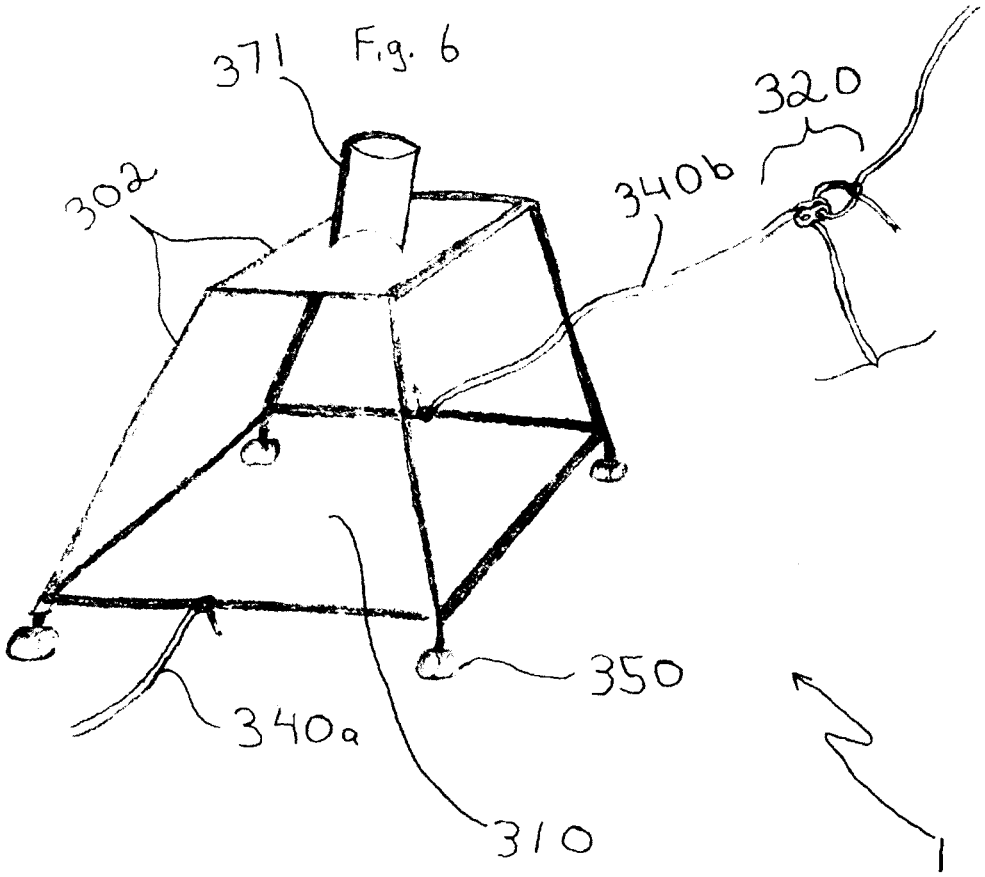
FIG. 6 is a perspective view an apparatus for remotely performing operations on a roof, according to one embodiment.

FIG. 6 is a perspective view illustrating apparatus 1, according to one embodiment shown, wherein apparatus 1 is configured as a frame assembly 302 on which a vision system 371 is mounted to perform remote inspections. Frame assembly 302 consists of structural elements defining an open central space 310. A first segment of the flexible control line 340*a* is secured to the frame assembly 302 and extends substantially in a first direction to a second end disposed at the operating position. A first end of the second segment of flexible control line 340*b* is secured to the frame assembly 302. The second end extends through pivot assembly 320 which redirects the second segment substantially to the first direction, ending at the operating position. The frame assembly 302 is shown containing optional wheels 350 to facilitate movement of the frame assembly 302 on a roof.

Although not illustrated, in other embodiments, frame assembly 302 could be fitted with a hose and nozzle such that air or fluid could be supplied to the roof and dispensed to perform operations such as blowing or flushing debris from the roof and or gutters, performing a cleaning operation such as cleaning skylights or solar panels, or applying a functional coating to the roof or fixtures on the roof such as skylights or solar panels. The frame assembly 302 could be fitted with tines or bristles for the removal of debris or the preparation of a roof surface for a subsequent operation. Such list is not intended to be complete but illustrates examples of operations that can be performed by the apparatus disclosed here.

What is claimed is:

1. An apparatus for remotely performing an operation on a roof, the apparatus comprising:

a frame assembly configured to be positioned on the roof;

a freely positionable pivot assembly configured to couple to a freely positionable external anchor point separate from the roof such that the frame assembly is positioned between the pivot assembly and an operating position; and a flexible control line including:

a first segment having a first end coupled to the frame assembly and extending in substantially a first direction to a second end disposed at the operating position; and a second segment having a first end coupled to the frame assembly and extending in a second direction substantially opposite the first direction through the freely positionable pivot assembly, which redirects the second to the first direction, to a second end at the operating position, wherein pulling the second ends of the first and second segments controls movement of the frame assembly on the roof.

2. The apparatus of claim 1, wherein the second end of the first segment is joined to the second end of the second segment so that the flexible line forms a loop.

3. The apparatus of claim 1, wherein the frame assembly includes at least one wheel for movement on the roof.

4. The apparatus of claim 1, wherein the freely positionable pivot assembly comprises a bar around which the flexible control line travels, wherein the flexible control line can move along a length of the bar in substantially lateral directions relative to the first direction.

5. The apparatus of claim 1, wherein the freely positionable pivot assembly includes a pulley around which the flexible control line travels.

6. The apparatus of claim 5, wherein the pulley is coupled to bar, wherein the pulley can move along a length of the bar in substantially lateral directions relative to the first direction.

7. The apparatus of claim 1, wherein the frame assembly is configured as a snow removal apparatus.

8. The apparatus of claim 1, wherein the frame assembly comprises a mounting frame for tools.

9. The apparatus of claim 1, wherein the operating position is at an elevation lower than the roof.

10. An apparatus for removing snow from a roof, the apparatus comprising:

a frame assembly configured to be positioned on the roof, the frame assembly including a first face and an opposing second face;

a pivot assembly configured to couple to an anchor point separate from the roof such that the frame assembly is positioned between the pivot assembly and an operating position at an elevation lower than the roof; and a flexible control line including:

a first segment having a first end coupled to the first face and extending in substantially a first direction to a second end disposed at the operating position; and a second segment having a first end coupled to the second face and extending in a second direction substantially opposite the first direction through the pivot assembly, which redirects the second segment to the first direction, to a second end at the operating position, wherein pulling the second ends of the first and second segments controls movement of the frame assembly on the roof.

11. The apparatus of claim 10, wherein the frame assembly comprises a face plate having a bottom edge disposed on the roof, a top edge, and a pair of side edges which form the first face and opposing second face.

12. The apparatus of claim 11, wherein the first face is concave in shape.

13. The apparatus of claim 11, wherein pulling the second segment in the first direction moves the faceplate toward an apex of the roof with the second face facing the apex, and pulling the first segment in the first direction pulls the faceplate toward an eve of the roof with the first face facing the eve to pull snow from the roof.

14. The apparatus of claim 11, wherein frame assembly includes a blade extending from the bottom edge.

15. The apparatus of claim 11, wherein the frame assembly includes one or more wheels along the bottom edge.

16. The apparatus of claim 10, wherein the frame assembly comprises a plurality of structural elements forming a perimeter structure defining an open central space, the structuring elements including a bottom structural element disposed on the roof, and a polymeric sheet extending from the bottom structural element in the first direction.

17. The apparatus of claim 16, including a blade extending from the bottom structural element opposite the polymeric sheet.

18. The apparatus of claim 17, wherein pulling the first segment in the first direction moves the frame assembly toward an eve of the roof, and pulling the second segment in the first direction moves the frame assembly toward an apex of the roof such that the bottom structural element undercuts snow on the roof with the undercut snow passing through the open central space and sliding down the polymeric sheet and off the eve of the roof.

19. The apparatus of claim 10, wherein the anchor point is a rope coupled to an element apart from the roof.

20. A method of removing snow from a roof comprising:

positioning a snow removal device on the roof, the snow removal device having a first face and an opposing second face;

anchoring a pivot assembly to an anchor point such that the snow removal device is positioned between the pivot assembly and an operating position at an elevation lower than the roof;

attaching a flexible control line having first and second segments to the snow removal device, including:

attaching a first end of the first segment to the first face and extending a second end of the first segment in a first direction to the operating position; and attaching a first end of the second segment to the second face and extending a second end of the second segment in a second direction opposite the first direction through the pivot assembly, which redirects the second segment to the first direction, to the operating position; and pulling the second ends of the first and second segments to control lateral and vertical movement of the snow removal device relative to an eve of the roof to remove snow from the roof.

21. The method of claim 20, wherein pulling the second ends of the first and second segments includes:

pulling the second end of the first segment in the first direction to pull the snow removal device down the roof from an apex toward the eve; and pulling the second end of the second segment in the first direction to pull the snow removal device up the roof from the eve toward the apex to remove snow from the roof.

22. The method of claim 20, wherein pulling the second ends of the first and second segments includes pulling the second ends of the first and second segments in a lateral direction relative to the roof eve to move the snow removal device laterally on the roof relative to the roof eve.

* * * * *